US006280802B1

(12) United States Patent
Akedo et al.

(10) Patent No.: US 6,280,802 B1
(45) Date of Patent: Aug. 28, 2001

(54) METHOD OF FORMING FILM OF ULTRAFINE PARTICLES

(75) Inventors: Jun Akedo; Hideki Takagi, both of Tsukuba (JP)

(73) Assignee: Agency of Industrial Science and Technology Ministry of International Trade and Industry, Tokyo (JP)

( * ) Notice: Subject to any disclaimer, the term of this patent is extended or adjusted under 35 U.S.C. 154(b) by 0 days.

(21) Appl. No.: 09/360,450

(22) Filed: Jul. 26, 1999

(30) Foreign Application Priority Data

Jul. 24, 1998 (JP) ..... 10-208998

(51) Int. Cl.[7] ..... B05D 1/02; B05D 3/06

(52) U.S. Cl. ..... 427/561; 427/446; 427/562; 427/523; 427/569; 427/180

(58) Field of Search ..... 427/446, 453, 427/475, 523, 529, 528, 531, 530, 561, 562, 564, 565, 569, 180

(56) References Cited

U.S. PATENT DOCUMENTS

| | | | | |
|---|---|---|---|---|
| 4,859,493 | * | 8/1989 | Lemelson | 427/523 |
| 5,075,257 | * | 12/1991 | Hawk et al. | 427/475 |
| 5,254,832 | * | 10/1993 | Gartner et al. | 427/561 |
| 5,489,449 | * | 2/1996 | Umeya | 427/453 |
| 5,552,125 | * | 9/1996 | Chamblee et al. | 427/453 |
| 5,616,368 | * | 4/1997 | Jin et al. | 427/562 |
| 5,853,815 | * | 12/1998 | Muehlberger | 427/453 |
| 5,935,461 | * | 8/1999 | Witherspoon et al. | 427/565 |
| 6,156,114 | * | 12/2000 | Bell et al. | 427/565 |

FOREIGN PATENT DOCUMENTS

| | | |
|---|---|---|
| 4-350175 | 12/1992 | (JP) . |
| 6-116743 | 4/1994 | (JP) . |

OTHER PUBLICATIONS

Seiichiro Kashu, pp. 55–59, "Kinzoku [METAL]," Jan. 1989.

Ikawa, et al., The Japanese Society of Precision Machine Engineering, pp. 191–192, Fall 1977 Annual Conference Technical Session Preprints, 1977.

* cited by examiner

*Primary Examiner*—Marianne Padgett
(74) *Attorney, Agent, or Firm*—Oblon, Spivak, McClelland, Maier & Neustadt, P.C.

(57) ABSTRACT

A method of forming a film of ultrafine particles includes the steps of accelerating ultrafine particles within a vacuum chamber to cause them to collide with a substrate and be deposited, and, at least before said ultrafine particles collide with said substrate, irradiating the ultrafine particles and the substrate with an ionic, atomic or molecular beam or low-temperature plasma or other high-speed, high-energy beam of high-energy atoms or molecules, whereby the surfaces of the ultrafine particles and substrate are activated without being fused, thus promoting bonding between said ultrafine particles and substrate or between the ultrafine particles to form a dense deposit that has good film properties and good adhesion to the substrate while maintaining the crystal properties of the ultrafine particles.

28 Claims, 12 Drawing Sheets

METHOD OF FORMING FILM OF ULTRAFINE PARTICLES

BACKGROUND OF THE INVENTION

1. Field of the Invention

This invention relates to a method of forming a film of ultrafine particles using a high-speed, high-energy beam.

2. Description of the Prior Art

In techniques for forming films of ultrafine particles wherein strong films of metals, ceramics or other ultrafine particles are formed by aerosolizing the particles by gas agitation and accelerating the particles through a fine nozzle as in the gas deposition method (Seiichiro Kashu: Kinzoku [Metal], January 1989, P. 57), or by electrically charging the particles and accelerating them with a magnetic field gradient as in the electrostatic particle coating method (Ikawa, et al., The Japanese Society of Precision Machine Engineering, Fall 1977 Annual Conference Technical Session Preprints, p. 191) and spraying upon and made to collide with a substrate, conventionally, when forming films of functional materials, it is difficult to maintain their structures at the time of the formation of films with ultrafine particles so there were cases in which adequate functionality could not be expressed.

This is because the aforementioned conventional methods of film formation worked on the fundamental principle that a portion of the kinetic energy is converted into thermal energy by colliding with the substrate and thus the ultrafine particles are sintered together and the ultrafine particles are sintered to the substrate. Thus, in the case of oxide materials that have a high melting point, when ultrafine particles are accelerated to speeds of several hundred meters per second or greater in order to obtain a heating temperature sufficient for fusion-bonding, the ultrafine particles are subjected to a large amount of distortion of their crystal structure or are pulverized due to the shock forces occurring at the time of collision with the substrate, so this is a drawback. In addition, this distortion causes a large amount of stress within the film, leading to problems such as degradation of the film characteristics and exfoliation from the substrate. Moreover, if the ultrafine particle material is a metal, an oxide film forms easily on its surface so it is difficult to obtain a film that has sufficient conductivity and adhesion to the substrate. In addition, even in the case of oxide ultrafine particle materials, the adhesion of moisture to its surface or the like reduces bonding among the ultrafine particles so it is difficult to obtain films with good characteristics.

On the other hand, the plasma spraying method is known as a technique of forming films by using a plasma gas to spray particles from a nozzle onto a substrate. This is a technique wherein particles with a particle size of several $\mu$m or greater are transported by gas in a high-temperature, high-speed plasma jet generated by ionizing inert gas, and the particles supplied by injection are heated and sprayed and accelerated to collide with the substrate by the high pressure generated at the same time, thus forming a film. The high-temperature plasma jet is obtained by generating an arc discharge by applying a high voltage between the negative and positive electrodes provided within the gun head used for spraying film materials, thus turning gas introduced at nearly atmospheric pressure into a high-temperature plasma.

However, the temperature of the plasma jet thus generated reaches 30000° C. in the hottest areas, so the deposited particles are heated from near the melting point to thereabove thus reaching a semi-molten or molten state and then sprayed at the substrate. Therefore, the crystal structure of the sprayed particles is destroyed and depending on the material, its composition may change due to differences in the vapor pressures of the constituent atoms, and moreover, it is difficult to control the state in which they are cooled and recrystallized upon adhering to the substrate, so there is a problem in which the crystal structure of the deposited film may differ greatly from the crystal structure of the original particle material.

For this reason, in order to give the deposit the crystal structure of the original ultrafine particle material and improve its characteristics, conventionally the deposited film had to be reheated to high temperature either during deposition or after deposition, and this heat treatment became a major problem in the formation of films of functional materials and their fine working in order to form small functional components or device components. Moreover, if the ultrafine particle material is a metal, it is difficult to obtain a film that has sufficient conductivity and adhesion to the substrate.

Moreover, in the case of techniques for the formation of thin films by PVD or CVD without using ultrafine particles, since a growth stage is passed through from the atomic or molecular state, in the case of oxide ceramics materials or the like, high-temperature heat treatment is often needed, and the film formation rate is also more than two orders of magnitude lower than that of the aforementioned film formation step using ultrafine particles, so obtaining a film with a thickness of several $\mu$m or greater is difficult in practice.

The invention came about in consideration of the aforementioned conventional drawbacks, and its object is to provide a method of forming films of ultrafine particles whereby even if a stream of ultrafine particles collides with the substrate at low speed, a strong bond is achieved between the ultrafine particles and the substrate at a low-temperature state, so the crystal properties of the ultrafine particles are maintained and a thin film with superior density and excellent adhesion is formed.

SUMMARY OF THE INVENTION

In order to achieve the object, this invention provides a method of forming a film of ultrafine particles comprising the steps of spraying ultrafine particles onto a substrate to form a film of deposited ultrafine particles and, at least before the ultrafine particles collide with the substrate, irradiating the ultrafine particles and substrate with an ionic, atomic or molecular beam or low-temperature plasma or other high-speed, high-energy beam of high-energy atoms or molecules, whereby the ultrafine particle materials of metals or ceramics with a particle size of 10 nm to 5 $\mu$m are not fused or decomposed and the surfaces of the ultrafine particles or substrate are made amorphous and activated by removing contaminant layers or oxide layers due to water molecules or the like adhering to the surface, thereby forming a thin film with superior density and excellent adhesion that, even if the stream of ultrafine particles collides with the substrate at low speed, achieves a strong bond between the ultrafine particles and the substrate at a low-temperature state to enable the crystal properties of the ultrafine particles to be maintained.

In addition, this invention provides a method of forming a film of ultrafine particles comprising the steps of introducing an aerosol consisting of ultrafine particles and ionized gas into a vacuum chamber and accelerating it through a fine nozzle, or dispersing and aerosolizing the ultrafine particles by vibration and then electrostatically charging them and accelerating them using an electric field gradient, thus forming a high-speed stream of ultrafine particles of metals, ceramics or the like with a particle size in the range from 10 nm to 5 μm and a high-speed, high-energy beam with which a substrate is irradiated, thus activating the atoms and molecules that make up at least the surfaces of the ultrafine particles and the surface of the substrate without causing fusing or decomposition of the ultrafine particles, thereby achieving low-temperature bonds between the ultrafine particles and the substrate and between ultrafine particles, and at the same time, moving the substrate relative to the ultrafine particle stream to form a film or arbitrarily-shaped deposit of the ultrafine particles on the substrate.

In the invention, the surfaces of the ultrafine particles and the substrate are activated by irradiation with a high-speed ionic, atomic or molecular beam or low-temperature plasma or other high-energy atoms or molecules. Therefore, in the deposit of ultrafine particle materials, the relative speed of the ultrafine particles in the direction perpendicular to the substrate should be in the range from 3 m/sec to 300 m/sec, as this is adequate for an impact pressure of the degree required for contact among the ultrafine particles and with the substrate. Thus, at this speed, dense deposition upon the substrate is possible with a high adhesion strength. As a result, the structural strain imparted to the crystal structure of the deposited ultrafine particle materials can be greatly reduced. In the above, speeds below 3 m/sec give inadequate density of the deposit while speeds above 300 m/sec cause damage or strain in the crystal structure of the ultrafine particles.

The aforementioned method of spraying an ultrafine particle stream onto a substrate can be implemented by the gas deposition method or vacuum spraying method, where ultrafine particles and gas are mixed within a high-pressure vessel, transported using a pressure difference within a low-pressure chamber that is pressurized and evacuated at the same time, and then sprayed through a nozzle. The method of generating and accelerating the ultrafine particle stream at this time is not limited to one wherein the ultrafine particles are mixed and dispersed in a carrier gas and sprayed from the nozzle, but rather the ultrafine particles may be dispersed by ultrasonic vibration, electromagnetic vibration, mechanical vibration or the like, and then charged and accelerated electrostatically to generate a uniform ultrafine particle stream with a larger surface area. In addition, in the case of electric field acceleration in this manner, in principle the pressure within the film-formation chamber can be made high vacuum (e.g., $10^{-5}$ Torr or less), so this irradiation with high-energy atoms or molecules can be performed under high vacuum with little contamination, so a thick film with excellent characteristics can be obtained.

In addition, the aforementioned high-speed, high-energy beam can be formed by applying a high voltage to an appropriate gas enclosed within an appropriate vessel such as a high-speed atomic beam gun at a pressure of several Torr or less, taking the low-temperature plasma thus generated and applying a voltage from a fine nozzle or opening or an acceleration electrode provided on the vessel, thus accelerating the ions to extract them as an ion beam with which the ultrafine particle stream and substrate are irradiated. In addition, the ion beam can be passed through a neutralizer (charge neutralizer) to give an electrically neutral beam and suppress its spreading, and further prevent any deterioration of the activation effect due to charges on the substrate or the ultrafine particles. moreover, depending on the object, the seed gas used to generate the high-speed, high-energy beam at this time may be the same as the carrier gas used to generate the ultrafine particle stream, or it may be different.

In addition, if the gas pressure within the vessel in which plasma generation is performed is higher than several Torr, discharges due to the application of voltage as in the case of plasma spraying will result in arc discharges so the energy density will become too high, causing the ultrafine particles with a particle size in the range from 10 nm to 5 μm to fuse, decompose or evaporate.

In addition, in the invention, when the method of generating the ultrafine particle stream using a nozzle within the vacuum chamber is used, a high-voltage power supply can be used with a conductive substrate and a conductive nozzle to apply a DC high voltage, and the ultrafine particles can be transported with a carrier gas and sprayed from the nozzle to generate a high-speed ultrafine particle stream, and at the same time, use this carrier gas as the seed gas for generating the plasma to form a high-speed, high-energy beam, and because the high-speed, high-energy atoms and molecules activate the substrate and ultrafine particle stream a film or arbitrarily-shaped deposit of the ultrafine particles can be formed upon the substrate. At this time, in order to cool the plasma formed by gas sprayed from the nozzle, the interior of the vacuum chamber must be evacuated to several Torr or lower. In the case that the substrate material is nonconductive, an electrode may be disposed behind the substrate material and the high voltage applied may be made AC, so the high-speed, high-energy beam can be formed and the substrate and ultrafine particles can be activated in the same manner as in the case of using a conductive substrate.

The acceleration of ultrafine particles is not limited to spraying from the nozzle, but rather electrostatic acceleration can be performed to generate a uniform ultrafine particle stream with a larger surface area, so instead of using the nozzle as an electrode, another electrode may be disposed near where the ultrafine particle stream passes and a high voltage may be applied in the same manner as in the above method to generate the low-temperature plasma. At this time, the seed gas for generating the high-speed, high-energy beam is supplied separately.

In addition, the invention also provides a method of forming films of ultrafine particles wherein a plasma generation coil to which a high voltage is applied is provided between the substrate and the ultrafine particle generator, a high-voltage power supply for applying a radiofrequency high-voltage signal to the coil is provided and a low-temperature plasma gas is generated, and by spraying the ultrafine particles from the ultrafine particle stream generator such that they pass through the low-temperature plasma gas, at least the ultrafine particles are activated, and a film or arbitrarily-shaped deposit of said ultrafine particles is formed upon said substrate.

At this time, in order to cool the plasma formed by gas sprayed from the nozzle, the interior of the vacuum chamber must be evacuated to several Torr or lower. The method of generating and accelerating the ultrafine particle stream in these film formation methods is not limited to one wherein the ultrafine particles are mixed and dispersed in a carrier gas and sprayed from the nozzle, but rather the ultrafine particles may be dispersed by ultrasonic vibration, electromagnetic vibration, mechanical vibration or the like, and then charged and accelerated electrostatically to generate a uniform ultrafine particle stream with a larger surface area. In this case also, the seed gas for generating the high-speed, high-energy beam is supplied separately.

In addition, in the invention, the use of argon, helium or other inert gas to generate the high-speed, high-energy beam is particularly effective in preventing surface oxidation when the ultrafine particle material is a metal, for example.

In addition, if the ultrafine particles to be deposited are oxide materials, by using air or oxygen or other gas that contains atoms or molecules of oxidizing gas to generate the high-speed, high-energy beam, the invention has the meritorious effect of being able to compensate for oxygen deficiency in the oxides during deposition of ultrafine particles, which occurs when the ultrafine particle materials to be deposited are oxides.

In addition, if the ultrafine particles to be deposited are nitride materials, by using air or nitrogen or other gas that contains atoms or molecules of nitriding gas to generate the high-speed, high-energy beam, the invention has the meritorious effect of being able to compensate for nitrogen deficiency in the nitrides during deposition of ultrafine particles, which occurs when the ultrafine particle materials to be deposited are nitrides.

In the invention, high-energy atoms or molecules of argon, helium or oxygen or other high-speed ionic, atomic or molecular beams or low-temperature plasma gases or the like irradiate or pass by the ultrafine particles or substrate used to activate at least the surface of the ultrafine particles or the surface of the substrate, thus promoting the bonding between an ultrafine particle and the substrate and between an ultrafine particle and an ultrafine particle to obtain dense films with good adhesion to the substrate while maintaining the crystal characteristics of the ultrafine particles, and thus improving the characteristics of the deposit.

Further objects and aspects of the invention will become clear in the following detailed explanation made with reference to the appended drawings.

BRIEF EXPLANATION OF THE DRAWING

FIG. 12(*b*) is a chart showing the results of X-ray diffraction analysis of the film obtained when irradiation with a high-speed, high-energy beam is not performed.

FIG. 12(*c*) is a chart showing the results of X-ray diffraction analysis of the PZT raw material powder used in the preferred embodiment.

DESCRIPTION OF THE PREFERRED EMBODIMENTS

As shown in the schematics of FIGS. 1–8, the invention is a method of forming films of ultrafine particles wherein the surfaces of aerosolized ultrafine particle materials transported in the gas-phase state are activated and sprayed onto a substrate and deposited. Moreover, as long as the particles have the crystal structure required for expression of functionality, there is no need to perform heating to high temperature during film deposition or after deposition yet it is still possible to form a film with the desired crystal structure. In addition, even in the case in which the fine particles used have a large particle size distribution due to secondary condensation, film formation is possible by means of energy assistance by high-speed, high-energy beams.

Figure 1:
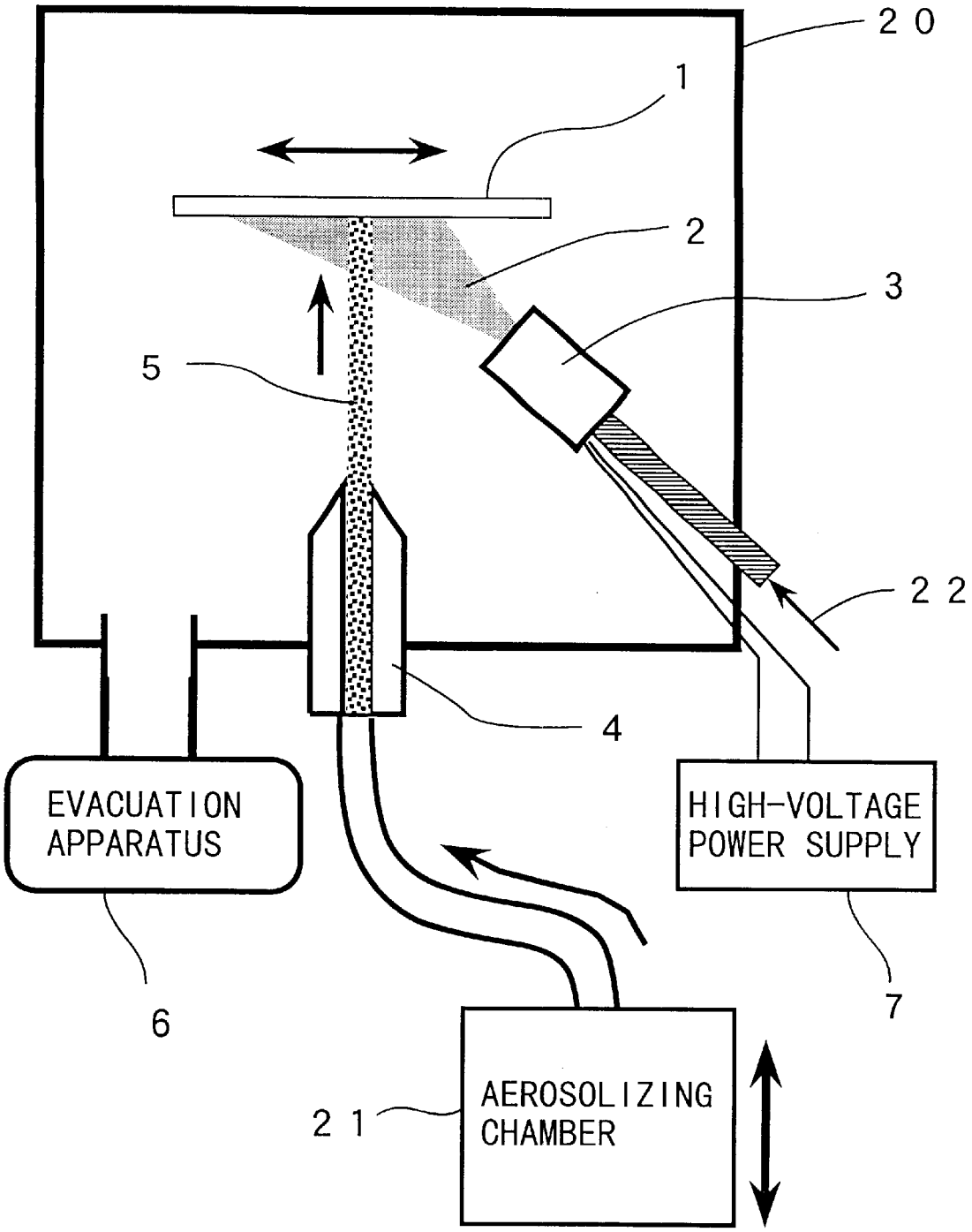
FIG. 1 is a schematic cross section showing the ultrafine particle film formation method in a first preferred embodiment 1 of the invention.

FIG. 1 shows a first embodiment of the invention. In a vacuum chamber 20, ionized gas 22 is introduced into a high-energy beam gun 3 provided with a negative electrode and a positive electrode (not shown) that generates a high-speed, high-energy beam and at the same time, a high voltage is applied by a high-voltage power supply 7 used to generate a high-energy beam, and a high-energy beam 2 which is an ionic, atomic or molecular beam or low-temperature plasma or other high-speed, high-energy beam of high-energy atoms or molecules is generated from the high-energy beam gun 3. Next, at least before an ultrafine particle stream 5, which is formed by passing an ultrafine particle stream from its source in an aerosolizing chamber 21 through a nozzle 4, collides with said substrate, the ultrafine particle stream 5 and substrate 1 are irradiated with the high-energy beam 2 generated in this manner, thereby activating the surfaces of the ultrafine particles and substrate 1. Since the interior of the vacuum chamber 20 is evacuated by an evacuation apparatus 6 to a pressure of several Torr or lower, the ultrafine particle stream 5 is sprayed through the nozzle 4 onto the substrate 1. At this time, the speed of the ultrafine particle stream 5 sprayed from the nozzle is controlled by the cross sectional area of the nozzle and the pressure of the aerosolizing chamber 21.

In the case of this method, the supply of film formation energy due to blowing the ultrafine particle materials against the substrate (kinetic energy) and the supply of ultrafine particle activation energy due to irradiation with the high-speed, high-energy beam 2 are performed independently, and moreover, it is possible to activate only the ultrafine particles or substrate, or activate both simultaneously, so it is possible to achieve a precise supply of energy which also has spatial selectivity, and thus it is easy to set the activation conditions and film formation conditions optimally depending on the ultrafine particle material without causing melting of the ultrafine particle material while maintaining its crystal structure. In addition, the seed gas used in film formation is not limited to only inert gas, but rather it is possible to use a mixture of different types such as oxidizing or reducing gases, so the formation of films by reactions (e.g., oxidation, reduction, nitridation, chlorination, carbonation reaction) can also be controlled independently of other conditions, so this method can be effectively applied to a wide range of combinations of ultrafine particle materials and substrate materials.

Moreover, the method of generating and accelerating the ultrafine particle stream used in the film formation method is not limited to the aforementioned method in which the ultrafine particles are mixed with and dispersed within a carrier gas and sprayed from the nozzle, but rather it is possible to disperse the ultrafine particles using ultrasonic vibration, electromagnetic vibration, mechanical vibration or the like and then give them charges and perform electrostatic acceleration to generate an ultrafine particle stream.

Figure 2:
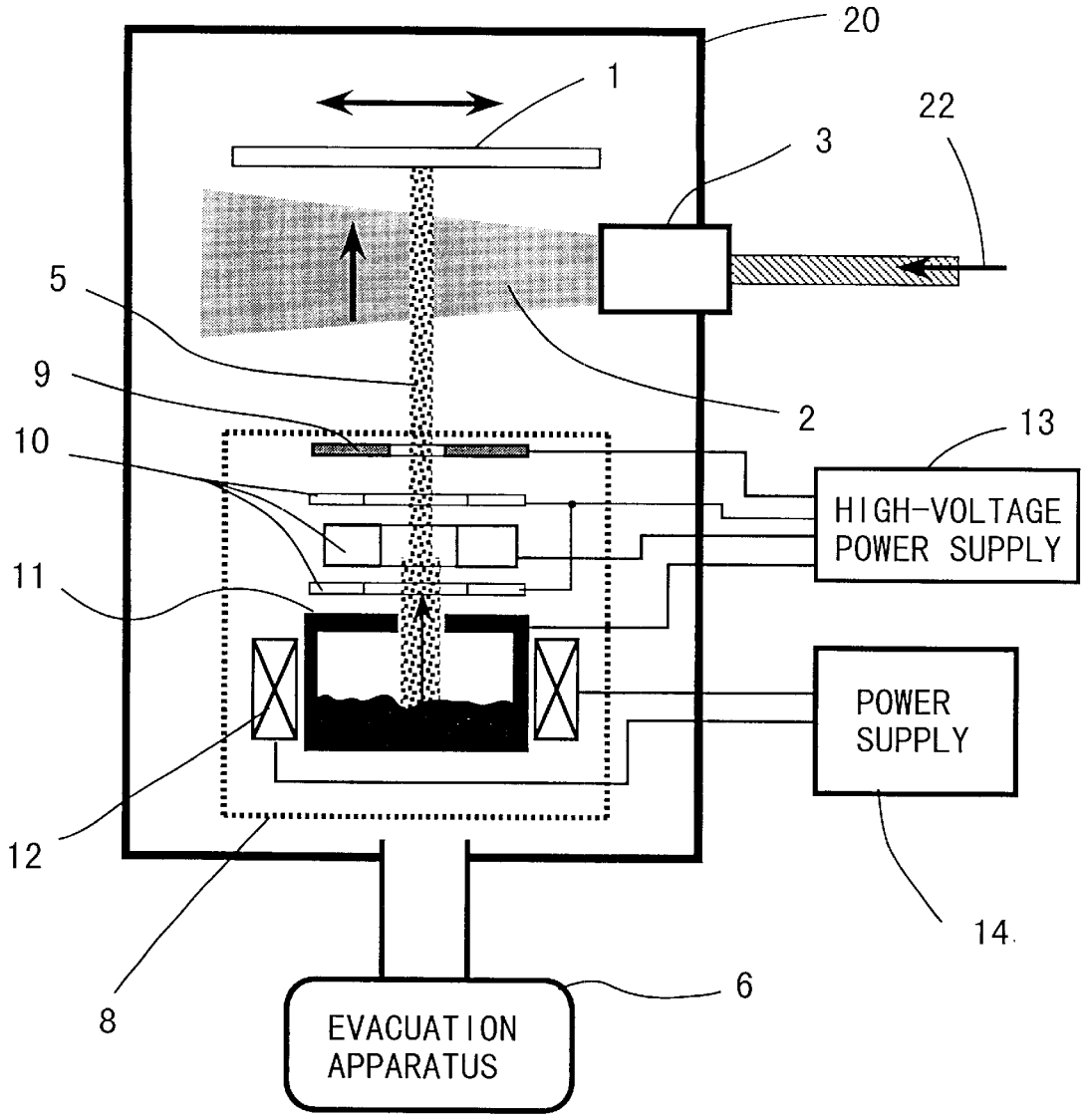
FIG. 2 is a schematic cross section showing the ultrafine particle film formation method in a second preferred embodiment of the invention.

FIG. 2 shows a second embodiment of the invention which utilizes the generation of an ultrafine particle stream by electric-field acceleration in this manner. In FIG. 2, the portion surrounded by the dotted line indicates an electromagnetic vibration-type ultrafine particle stream generation apparatus 8, where ultrafine particles accumulated in the ultrafine particle chamber 11 are vibrated and agitated by AC currents applied to an ultrafine particle excitation coil 12 by an ultrafine particle excitation power supply 14, and moreover, the particles are charged by a charge voltage from a high-voltage power supply 13 used to accelerate and focus ultrafine particles and carried out of the ultrafine particle chamber 11. Next, the ultrafine particle stream 5 is appropriately focused or dispersed by means of a high voltage applied by an electric field lens electrode 10 and accelerated toward the substrate 1 by a high voltage applied to an acceleration electrode 9 by a high-voltage power supply 13 used for ultrafine particle acceleration and focusing. In addition, the ultrafine particle stream 5 passes through a high-energy beam 2 emanating from a high-energy beam gun 3 into which is introduced an ionized gas 22, and reaches the substrate. At this time, the high voltage used for acceleration may be applied to the substrate 1 in the case that the substrate material is a conductor. In this case, gas is not used for transporting and accelerating the ultrafine particles, so the only seed gas is that used to generate the plasma introduced into the interior of the vacuum chamber 20, so this has the advantage that the ultrafine particle acceleration control and the vacuum chamber interior pressure control can be easily performed independently.

Note that as in the case of FIG. 1, the interior of the vacuum chamber 20 is evacuated by an evacuation apparatus 6 to a pressure of several Torr or lower.

Figure 3:
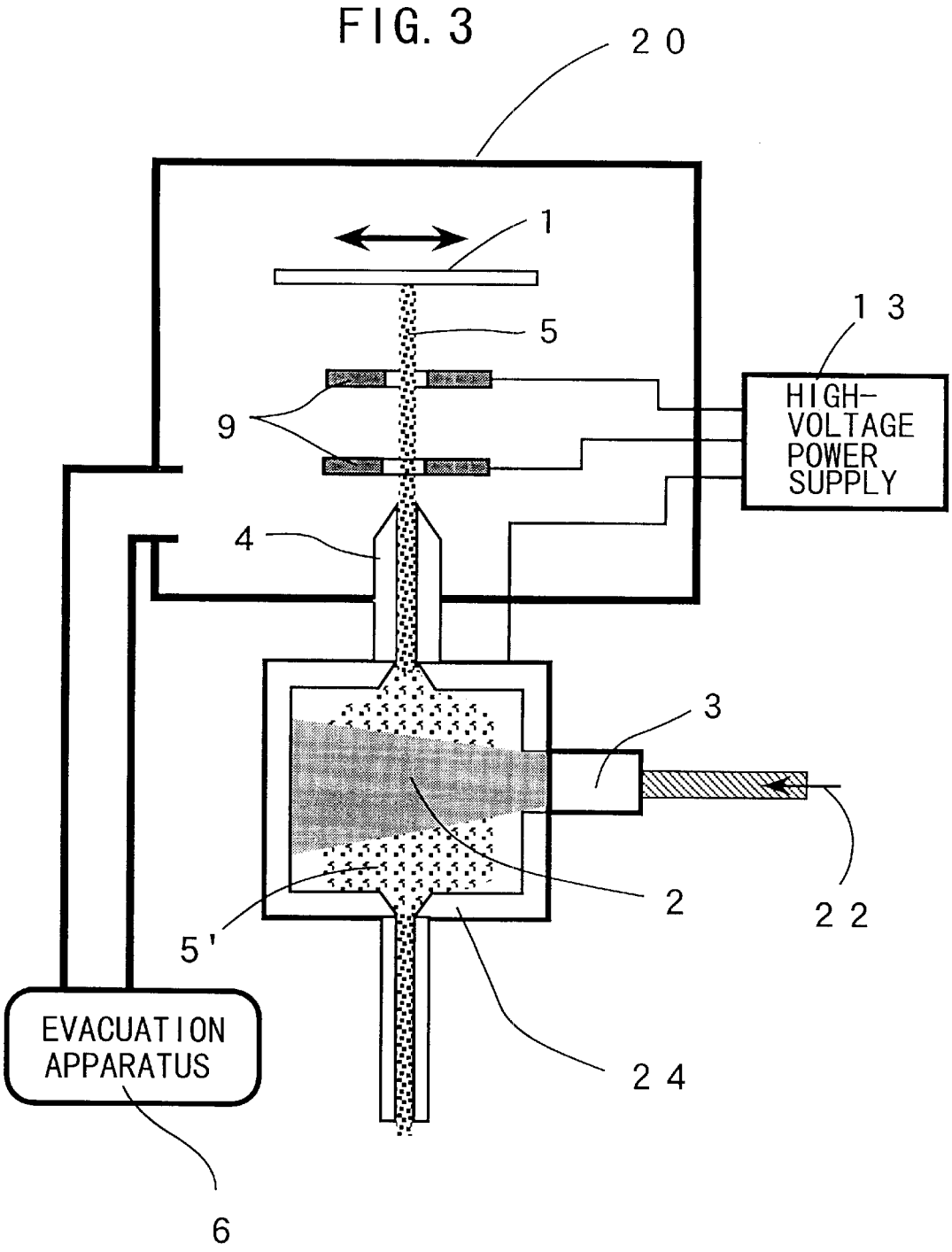
FIG. 3 is a schematic cross section showing the ultrafine particle film formation method in a third preferred embodiment of the invention.

FIG. 3 shows a third embodiment of the invention. An ultrafine particle stream deceleration chamber 24 provided with a high-energy beam gun 3 for generating a high-speed, high-energy beam is provided in front of the nozzle 4 for spraying ultrafine particles, and only the ultrafine particle stream 5' decelerated in this ultrafine particle stream deceleration chamber 24 are irradiated with the high-speed, high-energy beam 2. By decelerating the ultrafine particle stream in this manner, the time of interaction between the high-energy atoms or molecules and the ultrafine particles can be controlled, and the individual ultrafine particles in the ultrafine particle stream 5 can be appropriately activated and deposited upon the substrate 1. At this time, the ultrafine particle stream deceleration chamber 24 has a mechanism by which its cross section can be changed as needed as described above, so time of the interaction can be finely controlled independently of the speed of the ultrafine particle stream sprayed from the nozzle 4. In addition, as shown in FIG. 3, the charging electrode and acceleration electrode 9 can be used to accelerate the ultrafine particle stream 5' and adjust its speed within the vacuum chamber 20 before it reaches the substrate.

Figure 4:
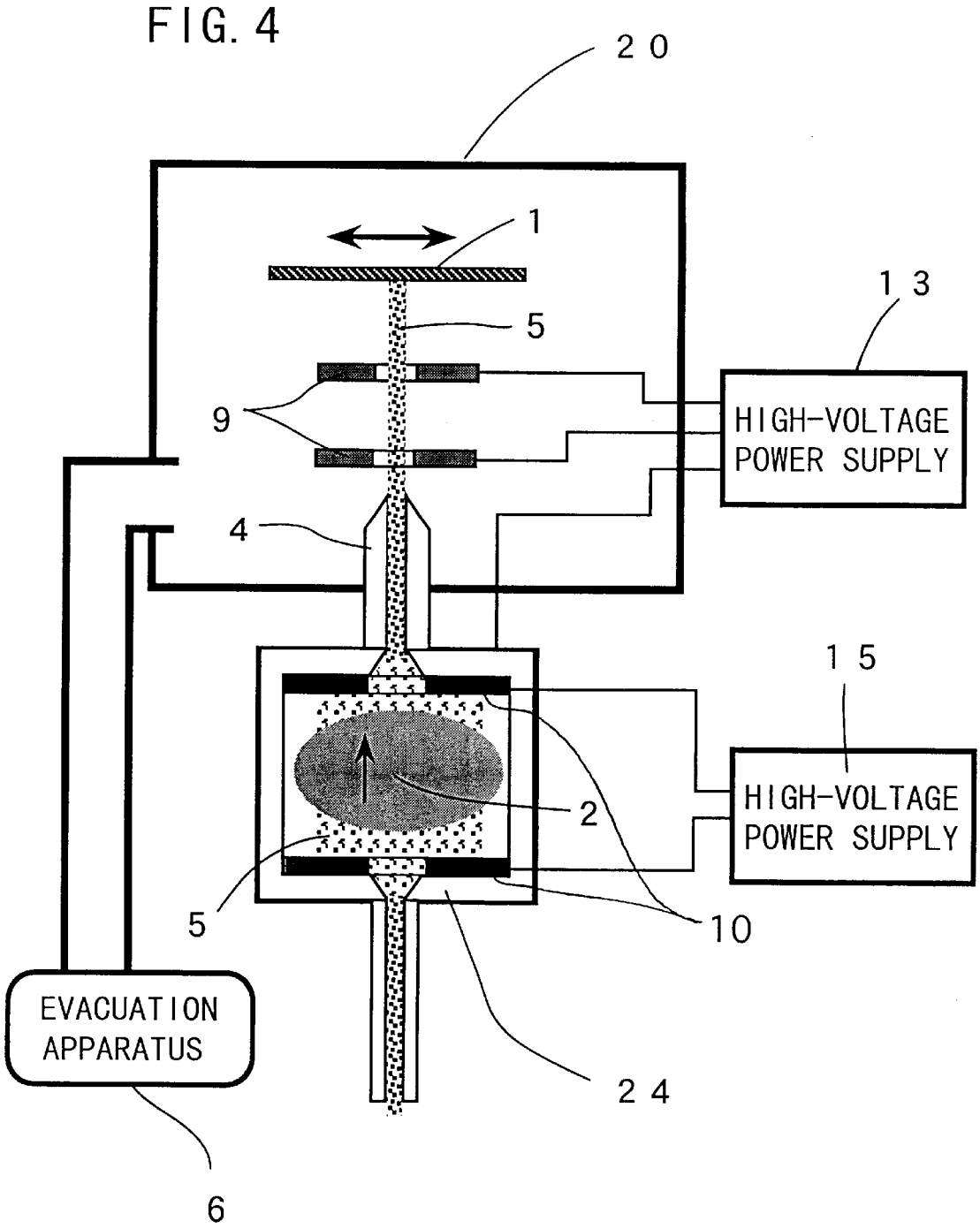
FIG. 4 is a schematic cross section showing the ultrafine particle film formation method in a modification of the third preferred embodiment of the invention.

The ultrafine particle stream deceleration chamber 24 is provided with the aforementioned mechanism by which its cross section can be changed as needed, and provided inside and outside of the mechanism are electrodes or coils for low-temperature plasma generation. By applying AC high voltage from a low-temperature plasma generation high-voltage power supply 15 to the electrodes and coils, it is also possible to activate the ultrafine particle stream 5. As shown in FIG. 4, for example, the ultrafine particle stream deceleration chamber 24 is provided therewithin with low-temperature plasma generation electrodes 10 to which high voltage is applied from the low-temperature plasma generation high-voltage power supply 15, thereby generating a low-temperature plasma 2 within the ultrafine particle stream deceleration chamber 24. By passing the ultafine particle stream 5 through the inside of the low-temperature plasma 2 at low speed, it is possible to prolong the time of interaction between the ultrafine particles and the high-energy beam or low-temperature plasma and activate the ultrafine particles with high efficiency.

Figure 5:
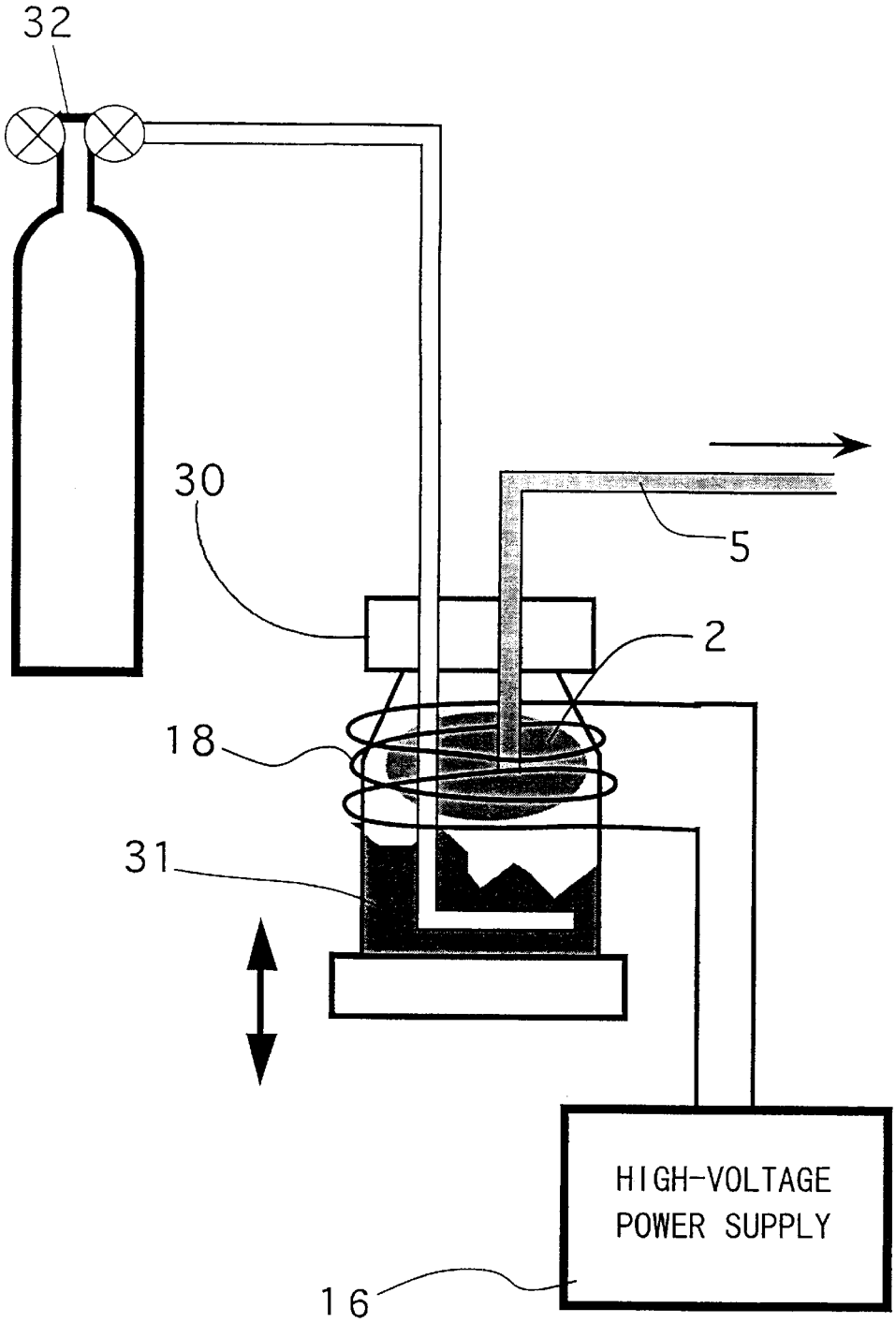
FIG. 5 is a schematic cross section showing the ultrafine particle film formation method in another modification of the third preferred embodiment of the invention.

As shown in FIG. 5, the same effect can be obtained by mixing the ultrafine particles and dispersing them within the gas, providing the outside of an aerosolizing chamber 30 for ultrafine particle stream generation to be regarded as the deceleration chamber with a conductive coil 18 for low-temperature plasma generation, applying AC high voltage from a low-temperature plasma generation high-voltage power supply 16 to the conductive coil to generate a low-temperature plasma 2 within the aerosolizing chamber 30. The ultrafine particle powder 31 contained in the aerosolizing chamber 30 is agitated and mixed together with the gas introduced from a gas cylinder 32 into the aerosolizing chamber 30, so the ultrafine particle powder is aerosolized and, by the low-temperature plasma 2 formed in the vicinity of the conductive coil 18, activated to form a ultrafine particle stream 5 that is supplied to the film formation chamber. The activated ultrafine particle stream 5 is then accelerated into an appropriate speed by the method using a nozzle as shown in FIGS. 1 and 3 and FIGS. 6, 8 and 9 to be described afterward or by the method utilizing charging and electrostatic acceleration as shown in FIG. 2 and FIGS. 7 and 10 to be described afterward and blown against the substrate to form a low-temperature dense film.

In the case of the method in which the mechanism for decelerating the ultrafine particle stream 5 is provided to activate the ultrafine particles, as described above, it is possible to precisely control the time of interaction between the ultrafine particles and the high-energy beam in response to the deceleration speed independently of the speed of the ultrafine particle stream 5 jetted from the nozzle and, by making the time of interaction long, it is possible to activate the ultrafine particles with high efficiency even when the beam has slight energy. In addition, not only the high-energy beam irradiated onto the ultrafine particle stream 5 from the high-energy beam gun shown in FIG. 3, but also a plasma generated by application of DC or AC high voltage used in the embodiments shown in FIGS. 6 to 10 can be adopted.

In the case of the method in the third embodiment also, the supply of film formation energy due to blowing the ultrafine particle materials against the substrate 1 (kinetic energy) and the supply of ultrafine particle activation energy due to irradiation with the high-speed, high-energy beam 2 are performed independently, and moreover, it is possible to activate only the ultrafine particles or substrate, or activate both simultaneously, so it is possible to achieve a precise supply of energy which also has spatial selectivity, and thus it is easy to set the activation conditions and film formation conditions optimally depending on the ultrafine particle material without causing melting of the ultrafine particle material while maintaining its crystal structure. In addition, the seed gas used in film formation is not limited to only inert gas, but rather it is possible to use a mixture of different types such as oxidizing or reducing gases, so the formation of films by reactions (e.g., oxidation, reduction, nitridation, chlorination, carbonation reaction) can also be controlled independently of other conditions, so this method can be effectively applied to a wide range of combinations of ultrafine particle materials and substrate materials.

At this time, by irradiation with the high-speed, high-energy beam, the surface of the ultrafine particles or surface of the substrate are made amorphous and activated by removing contaminant layers or oxide layers due to water molecules or the like adhering to the surface, so that a strong bond is achieved even without performing high-temperature heat treatment, and a dense film can be formed through "soft" collisions with the substrate or ultrafine particles without destroying the crystal structure of the ultrafine particles even without increasing the flight speed of the ultrafine particles.

Figure 6:
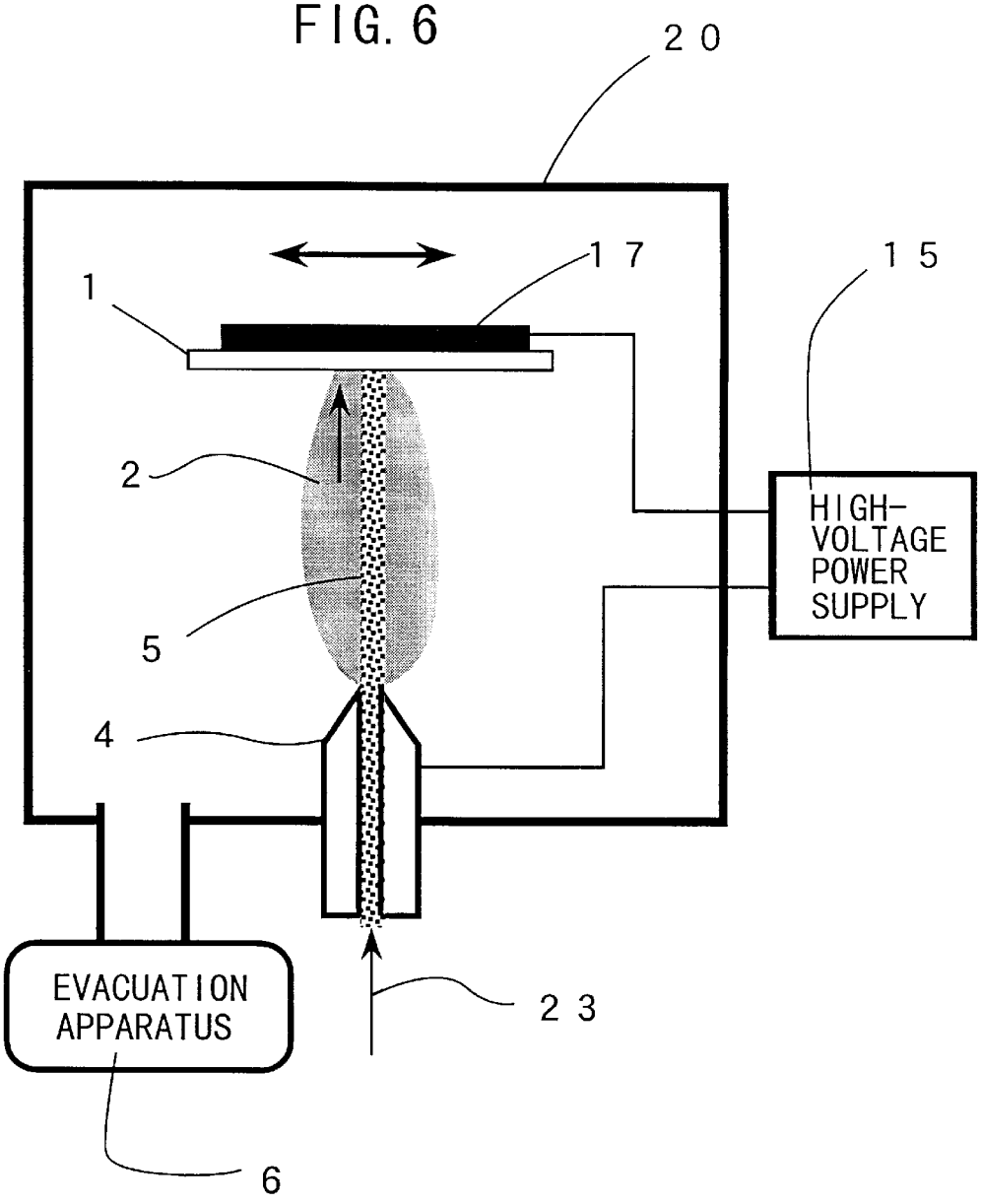
FIG. 6 is a schematic cross section showing the ultrafine particle film formation method in a fourth preferred embodiment of the invention.
Figure 7:
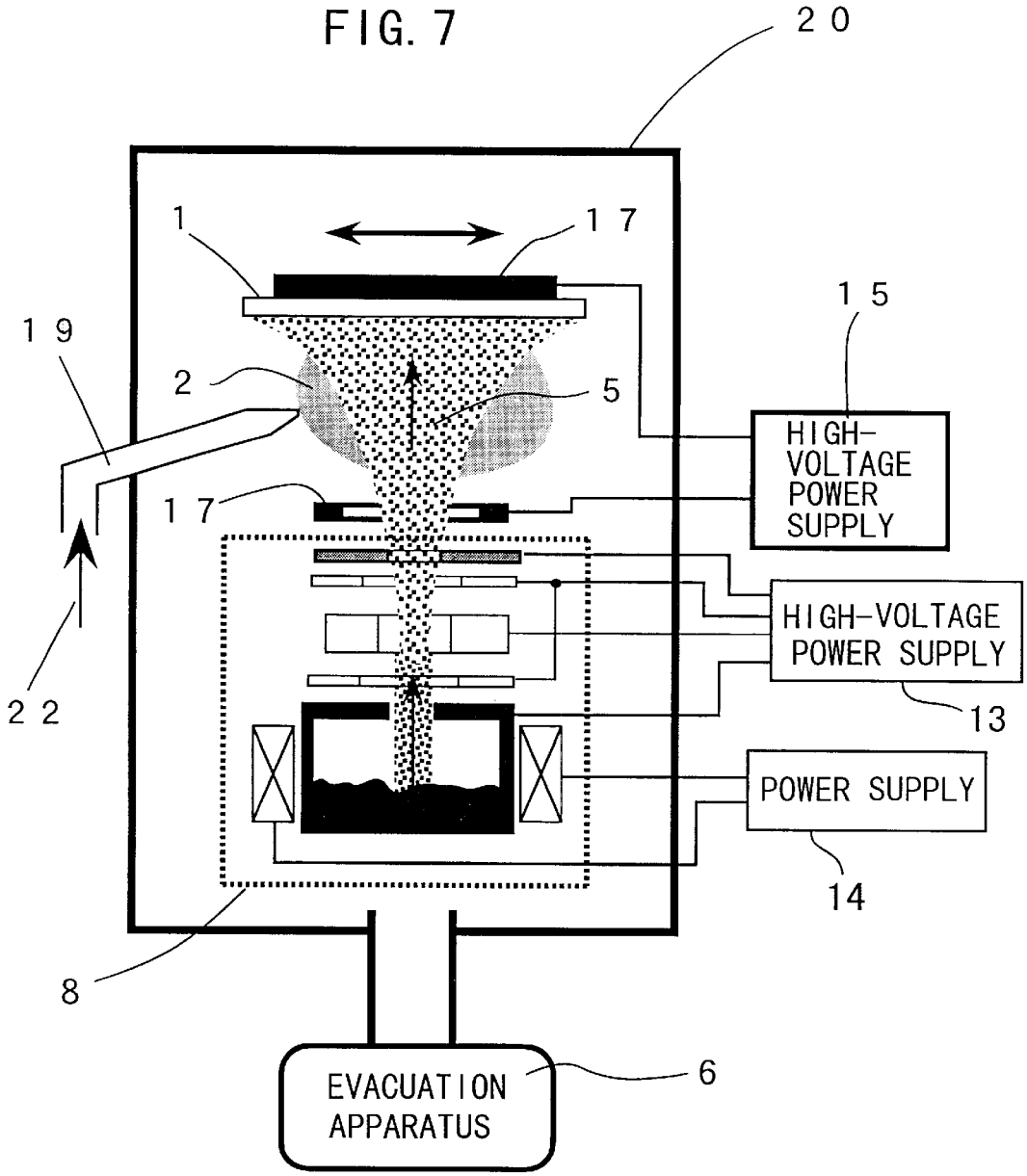
FIG. 7 is a schematic cross section showing the ultrafine particle film formation method in a fifth preferred embodiment of the invention.

FIG. 6 shows a fourth embodiment of the invention. In this method, a high voltage is applied from the low-temperature plasma generation high-voltage power supply 15 to the conductive substrate 1 and the conductive nozzle 4, and ionized gas and ultrafine particles 23 are supplied to the nozzle 4, so by converting the ionized gas used to transport the ultrafine particles into a plasma, a high-speed, high-energy beam 2 directed at the substrate is generated and the surface of the ultrafine particle stream 5 being transported and the surface of the substrate 1 are irradiated therewith. At this time, in order to lower the temperature of the plasma formed by the gas sprayed from the nozzle 4, the interior of the vacuum chamber is evacuated by the evacuation apparatus 6 to a pressure of several Torr or lower and the discharge due to the application of voltage must be made a glow discharge.

By means of this method, it is possible to bond even particles for which the kinetic energy required for deposition is not obtained, and the limitations on the particle size distribution of the particle materials used are also alleviated. This is extremely effective in reducing the cost of raw materials in practice.

Moreover, in the case in which the substrate 1 is made of non-conductive material, by disposing an electrode 17 as shown in FIG. 4 behind the substrate 1, changing the high voltage applied to AC radiofrequency, it is possible to form a high-speed, high-energy beam in the same manner as in the above case of using a conductive substrate.

FIG. 7 shows a fifth embodiment of the invention in which electrodes 17 for plasma generation and and an ionized gas introduction nozzle 19 for introducing ionized gas 22 are added to the aforementioned second embodiment of the invention shown in FIG. 2. To be specific, the electrodes 17 to which is applied a high voltage by the low-temperature plasma generation high-voltage power supply 15 are provided on the substrate 1 and at the spraying position of the ultrafine particle stream 5 in the electromagnetic vibration-type ultrafine particle stream generation apparatus 8. The ionized gas introduction nozzle 19 is positioned between the electromagnetic vibration-type ultrafine particle stream generation apparatus 8 and the substrate 1. The ultrafine particle stream 5 from the electromagnetic vibration-type ultrafine particle stream generation apparatus 8 is passed through the opening in the electrode 17 provided at the spraying position and also, the ionized gas 22 from the nozzle 19 is made into a plasma to give the high-speed, high-energy beam 2 and this ultrafine particle stream 5 irradiated with the beam 2 is sprayed onto the substrate 1.

By means of this preferred embodiment, seed gas is used for generating the high-speed, high-energy beam 2 from the ionized gas introduction nozzle 19, and no gas is used for the transport or acceleration of ultrafine particles, so the only seed gas is for plasma generation, and thus this method has an advantage in that the control of acceleration of the ultrafine particles and the control of the pressure within the vacuum chamber can be easily performed independently.

Figure 8:
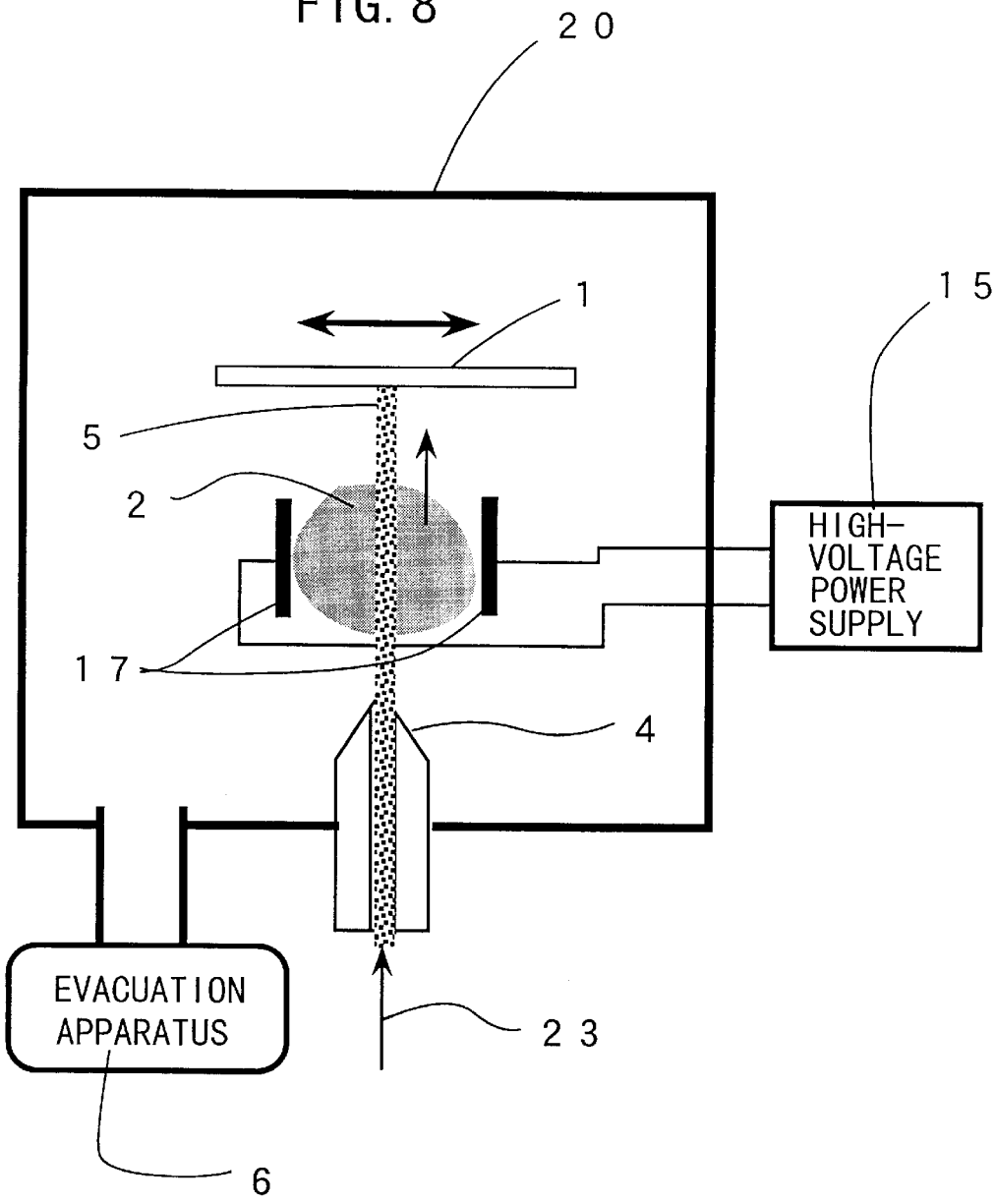
FIG. 8 is a schematic cross section showing the ultrafine particle film formation method in a sixth preferred embodiment of the invention.

FIG. 8 shows a sixth embodiment of the invention. Unlike in the aforementioned fourth embodiment of the invention shown in FIG. 6, electrodes 17 to which is applied a high voltage by the low-temperature plasma generation high-voltage power supply 15 are disposed in this embodiment below the substrate 1 such that they face each other, and thus the ionized gas sprayed from the nozzle 4 and the ionized gas of the ultrafine particles 23 are made into a plasma to give the high-speed, high-energy beam 2 and the surface of the ultrafine particle stream 5 being transported and the surface of the substrate 1 are irradiated with this high-energy beam 2.

In this case also, in the same manner as in the fourth embodiment of the invention above, it is possible to bond even particles for which the kinetic energy required for deposition is not obtained, and the limitations on the particle size distribution of the particle materials used are also alleviate. This is extremely effective in reducing the cost of raw materials in practice.

Figure 9:
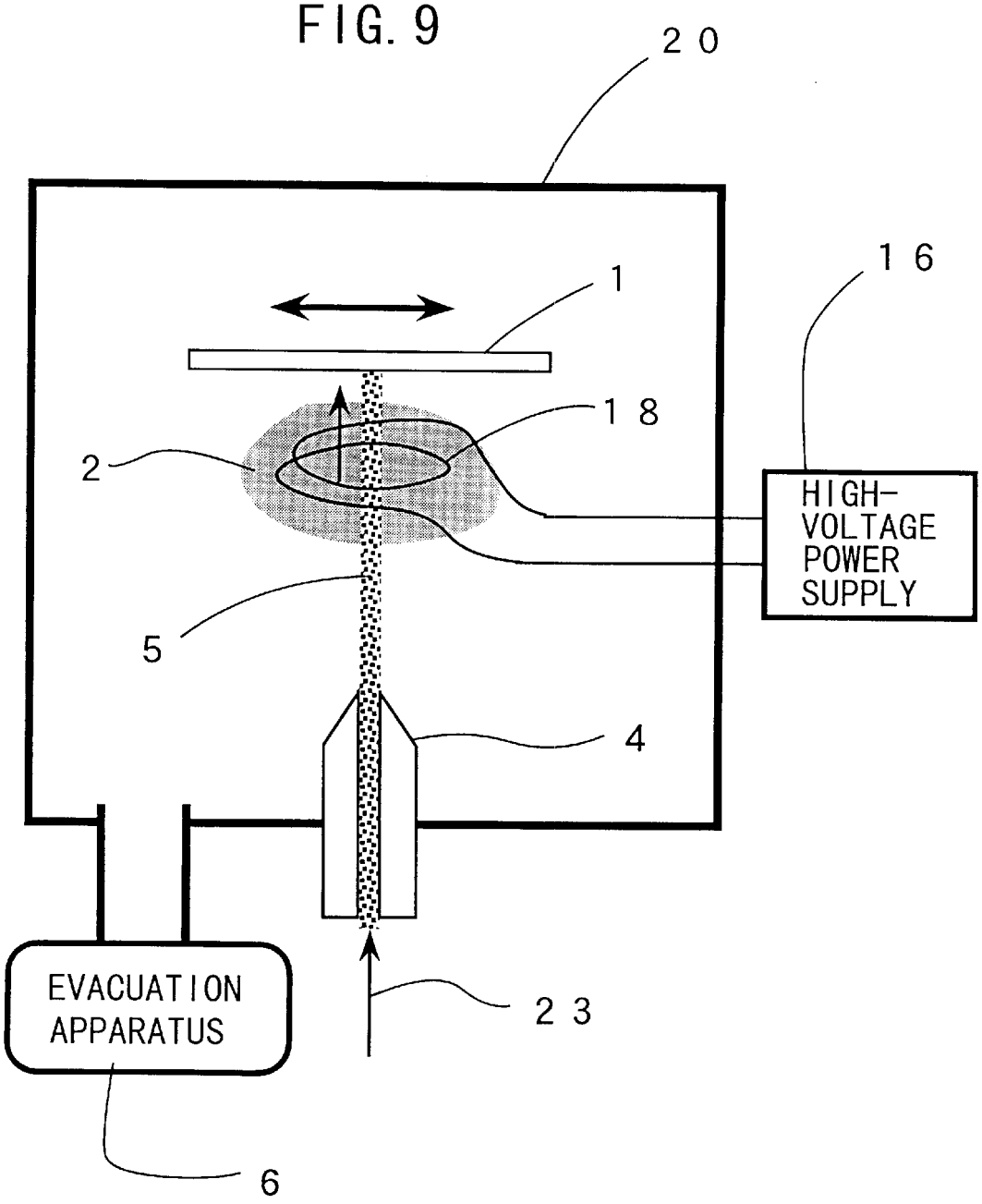
FIG. 9 is a schematic cross section showing the ultrafine particle film formation method in a seventh preferred embodiment of the invention.
Figure 10:
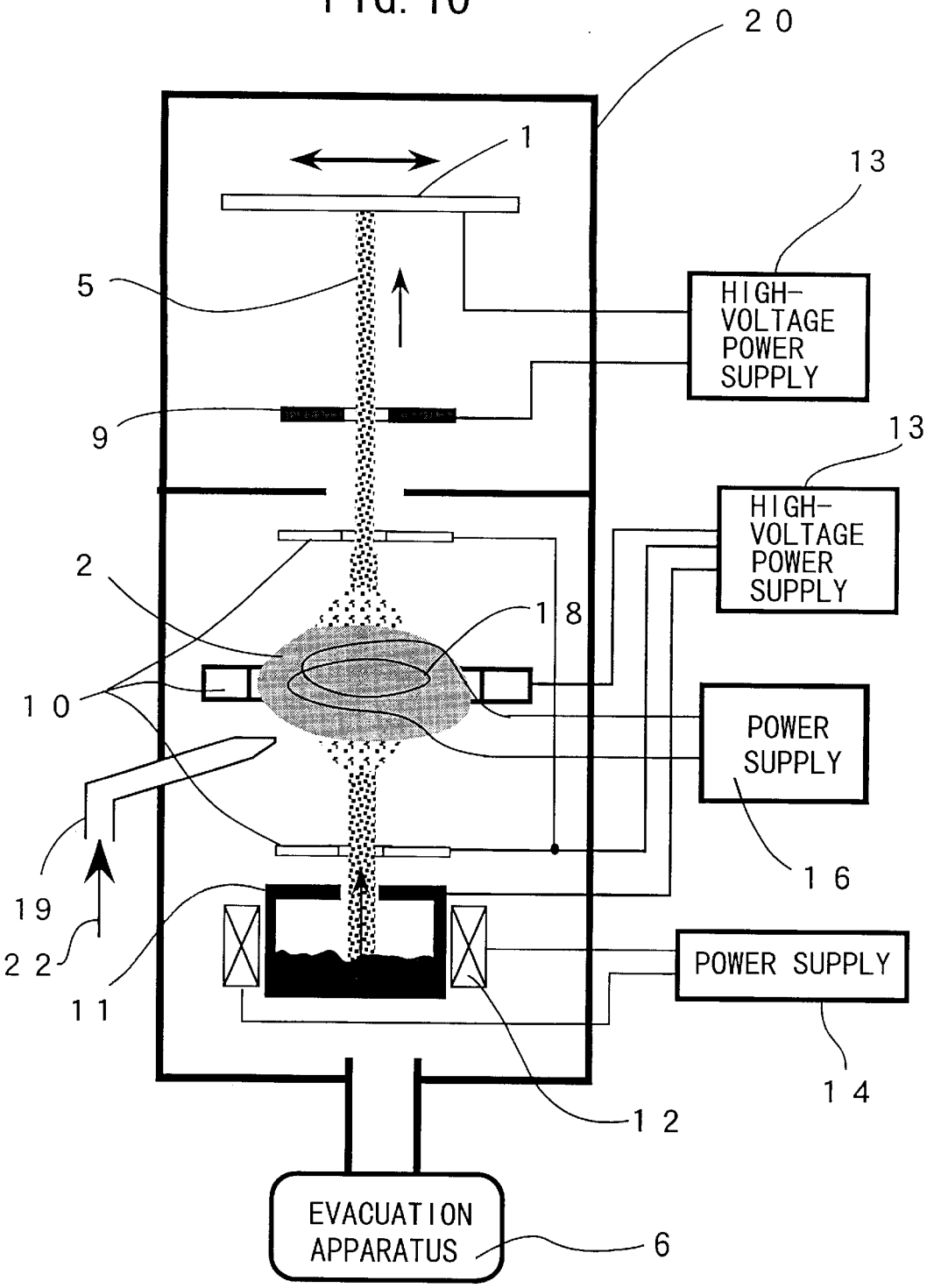
FIG. 10 is a schematic cross section showing the ultrafine particle film formation method in an eighth preferred embodiment of the invention.
Figure 11:
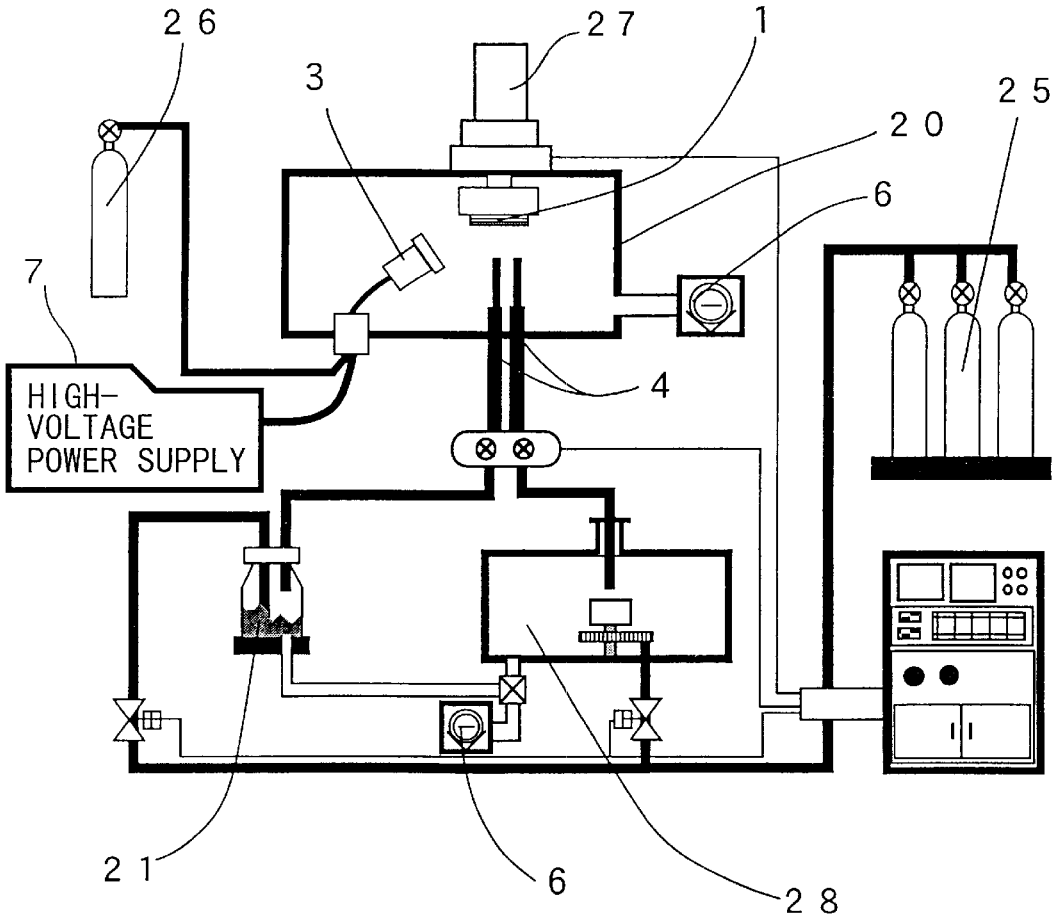
FIG. 11 is a schematic diagram of a film formation apparatus used to work the method of the invention.

FIG. 9 shows a seventh embodiment of the invention. A plasma generation coil 18 connected to a radiofrequency plasma generation power supply 16 is provided between the substrate 1 and the nozzle 4 that sprays ionized gas and ultrafine particles. The high-voltage radiofrequency current of this coil 18 turns the ionized gas used to transport the ultrafine particles into a high-speed, high-energy beam 2, and upon passing through the plasma space of this high-energy beam 2 the ultrafine particle stream 5 may be activated and deposited upon the substrate 1. In this case, in the same manner as in the fifth embodiment shown in FIG. 7, the seed gas for generating the plasma is supplied separately using an ionized gas introduction nozzle 19. In this case also, no gas is used for the transportation or acceleration of the ultrafine particles, so only the seed gas for generating the plasma is introduced into the interior of the vacuum chamber, so this has an advantage in that the control of the acceleration of the ultrafine particles and the control of the voltage within the vacuum chamber can be easily performed independently.

FIG. 10 shows an eighth embodiment of the invention, which adopts the ultrafine particle generation source of the aforementioned third embodiment of the invention shown in FIG. 3 and the method of dispersing ultrafine particles using ultrasonic vibration, electromagnetic vibration, mechanical vibration or the like and then giving them charges and performing electrostatic acceleration to generates a plasma by applying radiofrequency for the irradiation of a high-energy beam.

To wit, ultrafine particles accumulated in the ultrafine particle chamber 11 are vibrated and agitated by AC currents applied to an ultrafine particle excitation coil 12 by an ultrafine particle excitation power supply 14, and moreover, the particles are charged by a charge voltage from a high-voltage power supply 13 used for acceleration and focusing and are carried out of the ultrafine particle chamber 11. Next, the ultrafine particle stream 5 is appropriately dispersed by means of high voltage applied by an electric field lens electrode 10 and accelerated and sprayed toward the substrate 1 by a high voltage applied to an acceleration electrode 9 by a high-voltage power supply 13 used for ultrafine particle acceleration and focusing. At this time, the radiofrequency plasma generation power supply 16 applies radiofrequency voltage to a plasma generation coil 18 disposed near the ultrafine particle stream 5 which was spread out by the electric field of the electric field lens electrode 10, and the ultrafine particle stream 5 is irradiated with high-energy atoms and molecules so the surfaces of these ultrafine particles are activated. Then, these activated ultrafine particles are accelerated by the electric field formed between the acceleration electrode 9 and the substrate 1 and film formation is performed. At this time, in the same manner as in the fifth embodiment shown in FIG. 7, the seed gas for generating the plasma is supplied separately using an ionized gas introduction nozzle 19. In this case also, no gas is used for the transportation or acceleration of the ultrafine particles, so only the seed gas for generating the plasma is introduced into the interior of the vacuum chamber, so this has an advantage in that the control of the acceleration of the ultrafine particles and the control of the voltage within the vacuum chamber can be easily performed independently.

By changing the voltage applied to the electric field lens electrode 10 from the high-voltage power supply 13 used to accelerate and focus the ultrafine particles relative to the voltage applied to the ultrafine particle chamber 11, it is possible to adjust the speed of suitably dispersed ultrafine particle stream 5 passing through the neighborhood of the plasma generation coil 18, to control the time of interaction between the ultrafine particle stream 5 and the high-energy beam in the same manner as the embodiment and modifications of the invention shown in FIGS. 3 to 5 and, by making the time of interaction long, to activate the ultrafine particles with high efficiency even when the beam has slight energy.

In the film formation of the embodiments shown in FIGS. 1 to 11, the electric power supplied to generate a high-energy beam 2 from the high-energy beam generation high-voltage power supply 7, low-temperature plasma generation high-voltage power supply 15 or high-frequency plasma generation power supply 16 to the high-energy beam gun 3, low-voltage plasma generation electrode 10 or plasma generation coil 18 is desired to be not more than 1 KW in order not to melt the ultrafine particles by irradiation of the high-energy beam 2.

By means of these methods, it is possible to bond even particles for which the kinetic energy required for deposition is not obtained, and the limitations on the particle size distribution of the particle materials used are also alleviated. This is extremely effective in reducing the cost of raw materials in practice.

Note that in the various embodiments, identical portions are given the same numerals and some explanations may be omitted.

Here follows a working example of the invention, but the invention is in no way limited by the following working example.

Specifically, the working was performed by the method illustrated in FIG. 1, using a high-speed atomic and molecular beam gun that generates high-energy atoms and molecules.

The ultrafine particles used were PZT ($Pb(Zr,Ti)O_3$: a piezoelectric material) with a perovskite structure, which has piezoelectric characteristics and a particle size of 0.1–5 $\mu$m, Mn-Zn ferrite ($Fe_2O_3(Mn,Zn)O$: a radiofrequency magnetic material), titanium dioxide ($TiO_2$; an antibacterial material) with an anatase or rutile structure, or other ultrafine particles of oxide ceramics, and 200 g of which was charged in the aerosolizing chamber 21. FIG. 9 shows the structure of an ultrafine particle film formation apparatus that uses He gas supplied from an ultrafine particle transportation gas cylinder 25 as the carrier gas. A high-speed atomic and molecular beam gun 3 that generates high-energy atoms and molecules is mounted on the ultrafine particle film formation apparatus of FIG. 11 in the manner shown in FIG. 1, and oxygen supplied from an ionized gas cylinder 26 is used as the source gas for the formation of films upon Si substrates, stainless-steel substrates, alumina substrates at a room-temperature substrate temperature during irradiation with a high-speed atomic oxygen beam. At this time, an X-Y-Z stage 27 is used to scan the substrate 1 with respect to the nozzle 4 (aperture: 10 mm×0.4 mm) depending on the film geometry.

The speed of the stream of ultrafine particle gas was approximately 50 m/sec or less, the pressure within the film formation chamber 20 was brought to between 0.2 Torr and $2\times10^{-4}$ Torr by the evacuation apparatus 6, and the voltage applied to the high-speed atomic and molecular beam gun that generates the high-speed atomic oxygen beam was 1 kV, 20 mA to 2 kV, 50 mA. As a result, a film having a thickness of 100 to 500 $\mu$m could be obtained at the film formation speed of 5 to 20 $\mu$m/min.

Figure 12A:
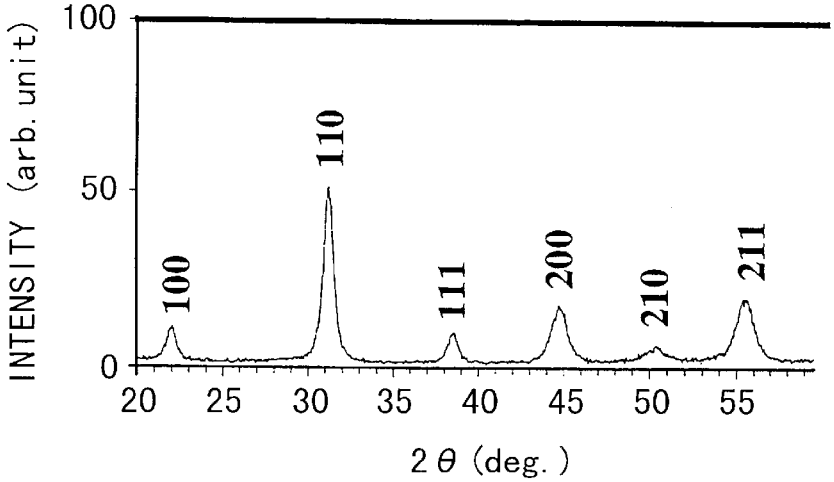
FIG. 12(*a*) is a chart showing the results of X-ray diffraction analysis of the film obtained in the preferred embodiment of the invention.
Figure 12B:
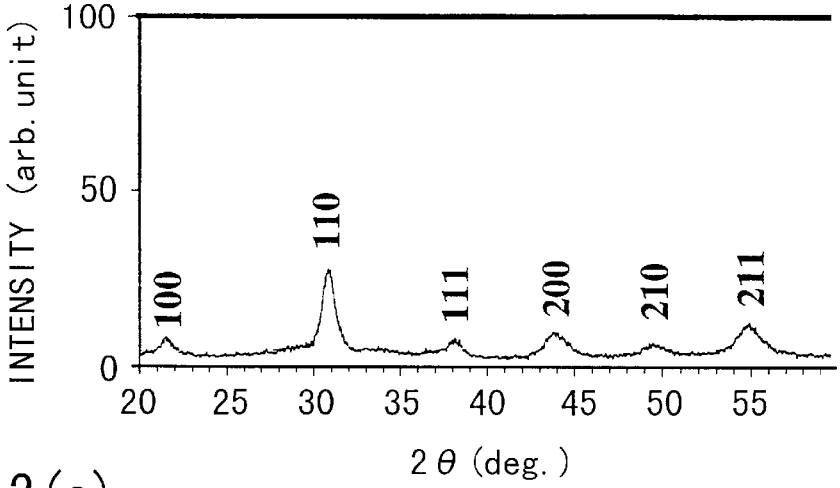
Figure 12C:
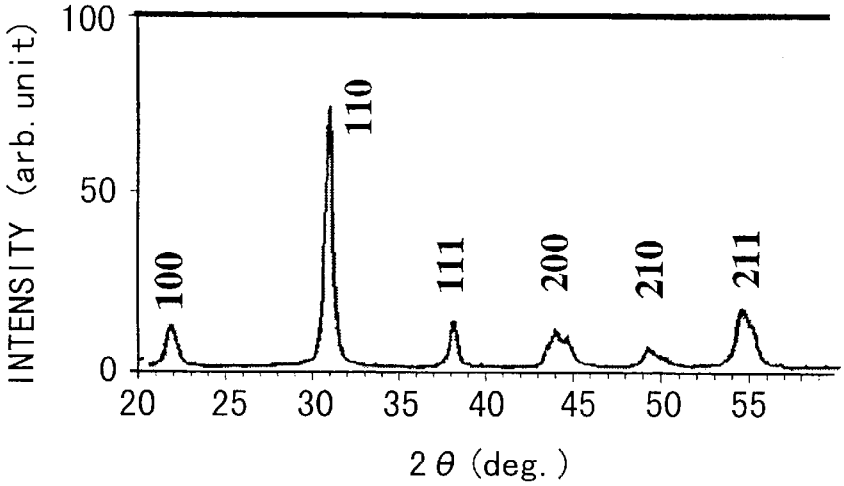

The results of X-ray diffraction analysis of the film thus obtained are shown in FIG. 12(*a*). For comparison, the results of X-ray diffraction analysis of the film obtained when irradiation with the high-speed atomic oxygen beam was not performed are shown in FIG. 12(*b*).

As shown in FIG. 12(*a*), the diffraction peaks were sharper for the film formed under irradiation with the high-speed atomic oxygen beam, and the deposited film maintained its dense crystal structure the same as the structure of the raw material powder as shown in the results of X-ray diffraction analysis given in FIG. 10(*c*).

In addition, when dry compressed air was used as the PZT ultrafine particle carrier gas, and a high voltage of about several tens of W to 100 W was applied between the spraying gas and the substrate to generate an air plasma while film formation was performed, it was possible to obtain a dense film that maintained the same crystal structure as the perovskite structure of the raw material powder and were confirmed to have improved piezoelectric characteristics.

In addition, when metal is used as the ultrafine particle material, inert gas is introduced into a metal ultrafine particle generation chamber 28. The metal material is evaporated in gas to generate the metal ultrafine particles. The metal ultrafine particles thus generated are carried to the vacuum chamber 20 using the inert gas as the carrier gas, and sprayed from the ultrafine particle spraying nozzle 4 toward the substrate 1 while being irradiated with the high-speed inert atomic beam from the high-energy beam gun 3 under the conditions of 5 kV and 10 mA, and film formation is thus performed.

When Ni was used as the ultrafine particle material and polyimide as the substrate material and film formation was performed without heating the substrate, a strong, non-exfoliating film 100 $\mu$m in thickiess and not less tnan are in density was formed.

Although the invention was thus explained with reference to embodiments illustrated in the drawings, the invention is in no way limited to the aforementioned embodiments but rather it can be worked in any manner as long as the composition recited in the claims is not changed.

As described in the foregoing, according to the invention, even when functional materials that require recrystallization at high temperature are used, as long as the particles of the raw material powder have the crystal structure required to express the function, a dense film having the desired crystal structure can be formed rapidly without the need for heating to a high temperature during deposition or after deposition.

In addition, if the ultrafine particles to be deposited are oxide materials, by using oxygen gas as the source gas for the high-speed, high-energy beam to be irradiated, it is possible to compensate for oxygen deficiency due to the collision of ultrafine particles during deposition or heating of the substrate, so it is possible to improve characteristics and functionality.

Moreover, even in the case that the particles to be used have a large particle size distribution due to secondary condensation, it is possible to bond even particles for which the kinetic energy required for deposition is not obtained and the limitations on the particle size distribution of the particle materials used are also alleviated, so this invention has many excellent effects.

What is claimed is:

1. A method of forming a deposit of particles, comprising the steps of:

accelerating crystalline particles with a particle size of about 10 nm to about 5 $\mu$m within a vacuum chamber so as to cause the particles to collide with a substrate and be deposited thereon, and at least before said particles collide with said substrate, irradiating the particles and the substrate with a particle beam having an energy such that surfaces of the particles being irradiated and the substrate arc activated without being fused, wherein said particles form a deposit on the substrate having a density of not less than 95%, while maintaining crystalline properties of particles.

2. The method of forming a film of particles according to claim 1, wherein a particle generator for spraying particles at said substrate, and a beam generator for irradiating a stream of the particles sprayed from said particle generator and said substrate with said particle beam are disposed within the vacuum chamber, and the particle stream generated and sprayed from said particle generator toward the substrate, and said substrate, are irradiated with said high-speed, high-energy beam to activate the surfaces of the particles in said particle stream and the substrate, and said substrate is moved relative to said particle stream to form a deposit of said particles on said substrate.

3. The method of forming films of particles according to claim 1, wherein a high-voltage power supply is provided to apply a DC or AC high voltage to two electrodes provided near said particle stream or said substrate.

4. The method of forming a film of particles according to claim 1, wherein a plasma generation coil to which a high voltage is applied is provided between said substrate and said particle generator.

5. The method of forming a film of particles according to claim 1, wherein said particle stream is generated by mixing and dispersing particles in gas and then accelerated by being passed through a particle spraying nozzle.

6. The, method of forming a film of particles according to claim 2, wherein said particle stream is generated by mixing and dispersing particles in gas and then accelerated by being passed through a particle spraying nozzle.

7. The method of forming a film of particles according to claim 3, wherein said particle stream is generated by mixing and dispersing particles in gas and then accelerated by being passed through a particle spraying nozzle.

8. The method of forming a film of particles according to claim 4, wherein said particle stream is generated by mixing and dispersing particles in gas and then accelerated by being passed through a particle spraying nozzle.

9. The method of forming a film of particles according to claim 1, wherein said particle stream is generated by dispersing particles by vibration then charged and accelerated electrostatically.

10. The method of forming a film of particles according to claim 2, wherein said particle stream is generated by dispersing particles by vibration then charged and accelerated electrostatically.

11. The method of forming a film of particles according to claim 3, wherein said particle stream is generated by dispersing particles by vibration then charged and accelerated electrostatically.

12. The method of forming a film of particles according to claim 4, wherein said particle stream is generated by dispersing particles by vibration then charged and accelerated electrostatically.

13. The method of forming a film of particles according to claim 1, wherein the particles have a relative speed in the direction perpendicular to the substrate that is in the range from 3 m/sec to 300 m/sec.

14. The method of forming a film of particles according to claim 2, wherein the particles have a relative speed in the direction perpendicular to the substrate that is in the range from 3 m/sec to 340 m/sec.

15. The method of forming a film of particles according to claim 3, wherein the particles have a relative speed in the direction perpendicular to the substrate that is in the range from 3 m/sec to 300 m/sec.

16. The method of forming a film of particles according to claim 4, wherein the particles have a relative speed in the direction perpendicular to the substrate that is in the range from 3 m/sec to 300 m/sec.

17. The method of forming a film of particles according to claim 2, wherein said particles have a particle size in the range from 10 nm to 5 $\mu$m.

18. The method of forming a film of particles according to claim 2, wherein said particles have a particle size in the range from 10 nm to 5 $\mu$m.

19. The method of forming a film of particles according to claim 3, wherein said particles have a particle size in the range from 10 nm to 5 $\mu$m.

20. The method of forming a film of particles according to claim 4, wherein said particles have a particle size in the range from 10 nm to 5 $\mu$m.

21. The method of forming a film of particles according to claim 1, wherein said particles are irradiated with the particle beam at least before the particles collide with said substrate to control a time of interaction between the high-energy beam and the particles.

22. The method of forming a film of particles according to claim 2, wherein said particles are irradiated with the particle beam at least before the particles collide with said substrate to control a time of interaction between the high-energy beam and the particles.

23. The method of forming a film of particles according to claim 3, wherein said particles are irradiated with the particle beam at least before the particles collide with said substrate to control a time of interaction between the high-energy beam and the particles.

24. The method of forming a film of particles according to claim 4, wherein said particles are irradiated with the particle beam at least before the particles collide with said substrate to control a time of interaction between the high-energy beam and the particles.

25. The method of forming a film of particles according to claim 1, wherein the energy supplied to generate the high-energy beam is not more than 1 kW.

26. The method of forming a film of particles according to claim 2, wherein the energy supplied to generate the high-energy beam is not more than 1 kW.

27. The method of forming a film of particles according to claim 3, wherein the energy supplied to generate the high-energy beam is not more than 1 kW.

28. The method of forming a film of particles according to claim 4, wherein the energy supplied to generate the high-energy beam is not more than 1 kW.

* * * * *